US005337658A

United States Patent [19]

Bruke

[11] Patent Number: 5,337,658

[45] Date of Patent: Aug. 16, 1994

[54] CONVEYING AND COMPACTING APPARATUS HAVING A SHAFTLESS SPIRAL IN A CASING WITH DRAINAGE OPENINGS

[75] Inventor: Richard L. Bruke, Vintrie, Sweden

[73] Assignee: Spirac Engineering AB, Malmo, Sweden

[21] Appl. No.: 69,460

[22] Filed: Jun. 1, 1993

Related U.S. Application Data

[60] Continuation of Ser. No. 880,486, May 6, 1992, abandoned, which is a continuation of Ser. No. 550,143, Jul. 9, 1990, abandoned, which is a division of Ser. No. 236,643, Sep. 28, 1988, abandoned, which is a continuation of Ser. No. 829,142, Dec. 9, 1985, abandoned.

[30] Foreign Application Priority Data

Apr. 19, 1984 [SE] Sweden ..... 8402202

[51] Int. Cl.[5] ..... B30B 9/26

[52] U.S. Cl. ..... 100/127; 100/145; 100/117; 100/148; 198/659; 198/671; 198/676; 198/608

[58] Field of Search ..... 198/548, 550.1, 550.6, 198/608, 659, 661, 670, 671, 676; 414/218; 100/117, 145, 188 R, 127, 148

[56] References Cited

U.S. PATENT DOCUMENTS

| | | | |
|---|---|---|---|
| 351,014 | 10/1886 | Wissler | 198/659 |
| 2,177,179 | 10/1939 | Hendershott et al. | 198/676 |
| 3,802,551 | 4/1974 | Somers | 198/659 |
| 4,498,382 | 2/1985 | Pera et al. | 100/117 |
| 4,520,724 | 6/1986 | Costarelli | 100/117 |
| 4,779,528 | 10/1988 | Bruke | 100/117 |
| 5,000,307 | 3/1991 | Bruke | 198/608 |
| 5,217,108 | 6/1993 | Newnan | 198/670 |

FOREIGN PATENT DOCUMENTS 3122131 12/1982 Fed. Rep. of Germany .

OTHER PUBLICATIONS

Screw Press—Feb. 1981—Publication of ML Engineering AB Strain Press—Jul. 1989—Publication of Picatech AB.

*Primary Examiner*—Joseph E. Valenza
*Attorney, Agent, or Firm*—Ladas & Parry

[57] ABSTRACT

A method and apparatus for conveying and compacting material which includes fractions of different sizes, densities, elasticity, moisture-content etc. wherein a shaftless spiral is disposed in a casing and the spiral is driven in rotation at an end of the casing where the material is fed into the casing. At the opposite end of the casing, i.e. the end located adjacent a discharge section of the casing, the casing surrounds the spiral with slight play, and, moreover, the casing extends in an end region below the spiral to form a correction zone. Counterpressure brakes the movement of the material to compact the material in the compaction zone. The casing is provided with drainage holes in the compaction zone for discharge of liquid expressed from the compacted material during passage through the compaction zone.

20 Claims, 5 Drawing Sheets

CONVEYING AND COMPACTING APPARATUS HAVING A SHAFTLESS SPIRAL IN A CASING WITH DRAINAGE OPENINGS

This is a continuation of copending application Ser. No. 07/880,486 filed on May 6, 1992, which is a continuation of Ser. No. 550,143 filed Jul. 9, 1990 which is a division application of application Ser. No. 07/236,643 filed Sep. 27, 1988 which is a continuation application of application Ser. No. 06/829,142 filed Dec. 9, 1985, all abandoned.

FIELD OF THE INVENTION

The present invention relates to an apparatus for receiving, conveying and/or impacting of material in which are included fractions of different sizes, densities, elasticity, moisture-content and the like the apparatus including at least one shaftless spiral in which each spiral is disposed in a preferably closed casing and, more precisely, there are provided drive means, for the rotation of the spiral or spirals, repectively, in conjunction with that portion of the casing where the material is received, and there are provided, at least for one of the combinations of casing - spiral, counterpressure members which arrest or brake the movement of the material in conjunction with that portion of the casing which serves as a discharge portion for the material.

BACKGROUND

Material of the type mentioned by way of introduction needs to be moved in many different contexts, both in industrial operations and in, for example, municipal refuse disposal and management (ref-use handling, screenings from the wastewater treatment plants and so on). Consequently, such material is handled in large quantities daily and it is a reality that this handling cannot be effected without meeting a number of problems. These are because the material is, as a rule, difficult to handle, for example in that it is bulky and needs to be compacted in order to attain an acceptable level of transport economy. When the material is wet, it needs to be compacted in order to reduce the moisture-content so as thereby to make for greater ease of handling. For compacting material of the above-indicated type, the prior Art calls for the employment of separate compactors or screw presses.

One disadvantage inherent in hitherto employed combinations of conveyors and compactors is that the combinations require a great deal of space and are costly. In certain applications, hydraulic compactors are used, and in other applications, screw presses. The hydraulic compactors take up a great deal of space and operate intermittently, which occasions problems in, for example, the formation of material "bridges" at the infeed section, while the conventional screw presses find difficulty in swallowing the bridge and plug forming materials here under discussion. This is because the screw presses have a center shaft or axle about which ensnaring material such as textiles, plastic sheeting, strips etc. become wound and cause plug formation in the material flow.

SUMMARY OF THE INVENTION

The present invention contemplates a conveyor apparatus in which is included means for compaction of the material being conveyed and in which the above-indicated disadvantages are obviated to a remarkable extent. The invention relates to a combination of a shaftless spiral and a casing. The combination of spiral and casing creates a compact unit of equipment which makes for reliable convevance of the material and is used, according to the invention, to realize a compaction of the material at same time as the material is enclosed, which entails that the surrounding environment is not affected. In certain embodiments of the present invention, the employment of compaction reduces the moisture-content in the material, while in other embodiments, the compaction of the material constitutes the basis of a batchwise discharging of the material from the apparatus.

The apparatus includes at least one shaftless spiral which is disposed in a preferably enclosed casing of, for example, U-shaped and/or circular cross-section. A drive means for the rotation of the spiral is disposed in conjunction with that portion of the casing where the material is fed into the combination of casing and spiral, while in the other section of the casing, i.e. in conjunction with the discharge portion of the casing, there is provided a zone in which the casing is of a cross-section which entails that the casing completely surrounds the spiral with slight play. Moreover, the casing is provided with an end region in the extension plane of the spiral, in which the spiral is not enclosed by the casing and/or in which a counterpressure member is disposed. In this zone and/or in conjunction with the end section, compaction of the material takes place. In that portion of the end section where the spiral is not enclosed by the casing, there is a braking or arresting effect on the material which leads to its compaction. In certain embodiments, the compaction is further amplified in that the spiral is provided with progressively diminishing pitch. The spiral is completely free, i.e. is not journalled in that end which is directed towards the discharge section of the casing.

In one embodiment of the present invention, the counter-pressure member consists of a spring-loaded counterpressure plate which is movably journalled in the upper defining surface of the casing and/or in conjunction with the discharge opening of the casing. In certain embodiments, the counterpressure plate is disposed in a receptacle chamber. In other embodiments, the braking effect of the casing on the material is amplified in that the casing, most proximal the discharge opening, is provided with reduced inner cross-section.

In yet a further embodiment, the counterpressure member consists of a receptacle device, for example a container, a hose etc., the member being shiftable in the axial direction of the casing. During rotation of the spiral, the material is conveyed into the receptacle device, the material moving the receptacle device in the axial direction of the spiral.

In still a further preferred embodiment of the apparatus, the counterpressure member consists of a shaftless spiral disposed in a casing, this casing having an infeed opening connected to the discharge opening of the delivering casing. That casing which discharges the material is, in this instance, of an orientation which entails that its axis is directed towards the center axis of the spiral and the receiving combination of casing and spiral. The pitch, speed and/or radial extent of the spiral blades are, in the receiving combination, adapted so as to occasion a braking of the material movement before the material reaches the discharge opening of the disclosed casing. Hereby, it is possible in such operation to attain a substantially complete filling of the space in the receiving casing. The substantially complete filling constitutes a precondition for being able to convey the material upwardly in a more or less vertical direction. Thus, according to the present invention, it is possible to dispose the receiving combination with its axis directed, for example, horizontally, vertically, or therebetween.

In certain embodiments, the casing is provided with drainage openings which, preferably, are located in that region of the casing where compaction of the material takes place. In such an instance, an orientation of the casing is advantageously selected so as to entail that the discharge section of the casing is placed higher than its infeed section, whereby, on compaction, the pressed out liquid is conveyed in a direction opposite to the direction of movement of the material and is drained out from the casing through the previously-mentioned drainage openings.

The nature of the present invention and its aspects will be more readily understood from the following brief description of the accompanying Drawings, and discussion relating thereto.

DETAILED DESCRIPTION OF PREFERRED EMBODIMENTS

Figures 1, 1A, 1B, 1C, 2:
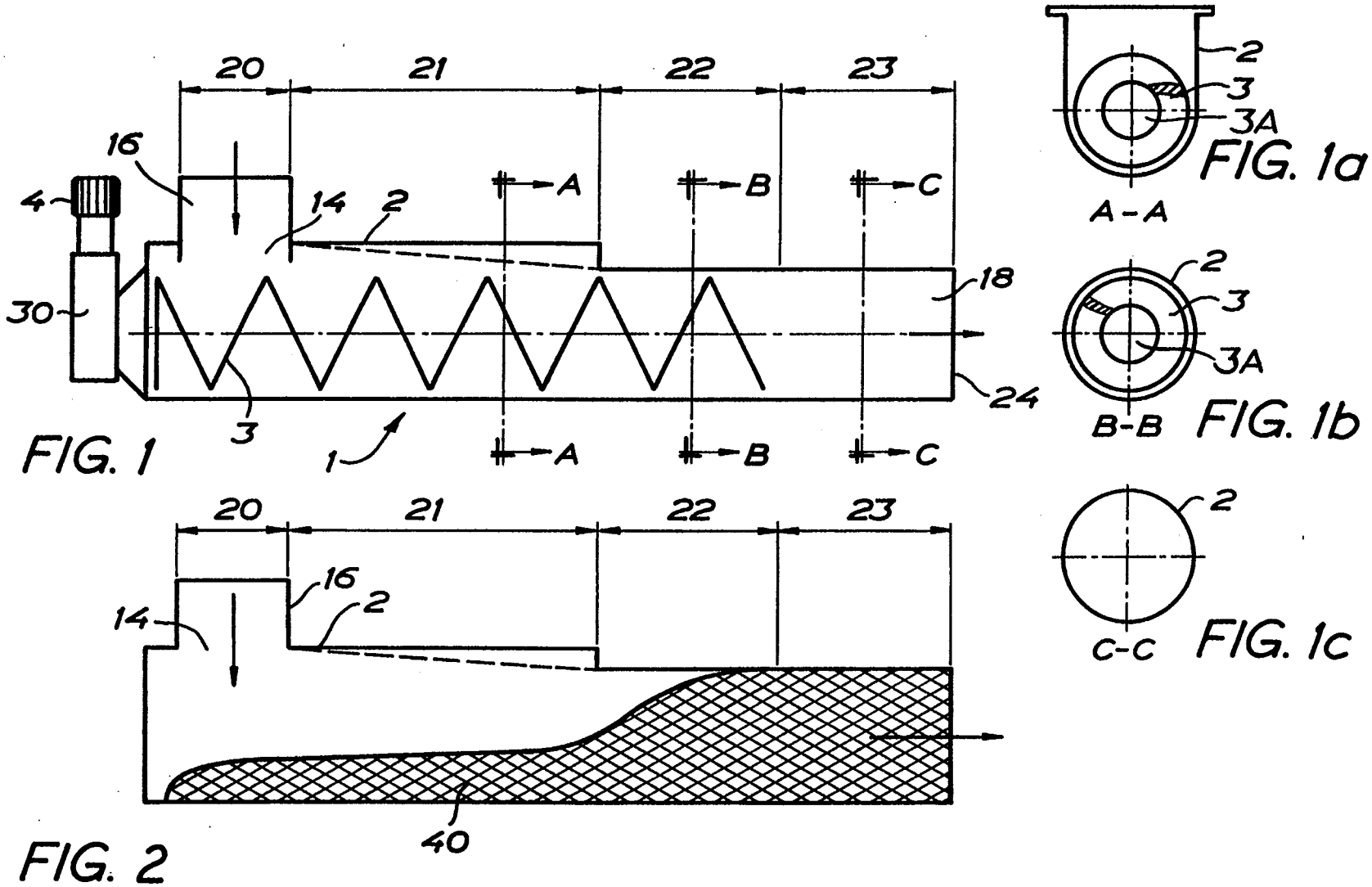
FIG. 1 is an axial section through an apparatus according to the present invention.
FIGS. 1*a–c* are sections taken along the lines A—A, B—B, and C—C in FIG. 1.
FIG. 2 shows the material distribution in the longitudinal direction of the apparatus.
Figure 3:
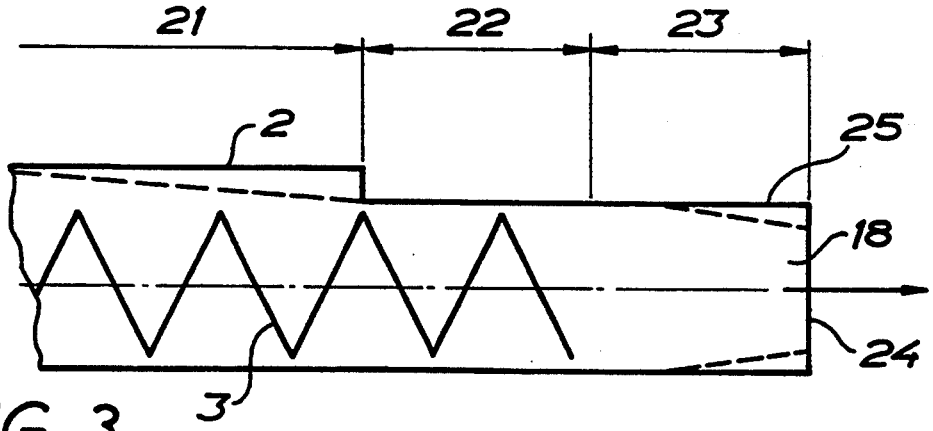
FIGS. 3, 4*a* 4*b*, 4*c* , and 5 illustrate embodiments of the apparatus according to the present invention provided with counter-pressure members for braking the material on its movement.

Referring to the Drawings, FIGS. 1 and 2 illustrate the invention in one embodiment which shows the fundamental construction and function of the invention. In these Drawing Figures, there is shown an apparatus 1 which includes an elongate, tube-like casing 2 in which is placed a shaftless spiral 3. At its one end, the casing is provided with an infeed opening 14 which connects to an up-warding-directed drum 16. A motor 4 drives the spiral 3 through the intermediary of a gearing and journalling unit 30. The other end of the casing constitutes the discharge portion 18 of the apparatus, which is provided with a discharge opening 24. The spiral is solely journalled in connection with the gearing and journalling unit, while that end of the spiral which is directed towards the discharge portion is fully free. Thereby, the shaftless spiral 3 defines a free central annular passage 3A extending longitudinally over the length of the spiral whereby substantially the entire cross section of the casing is available for travel of material therethrough.

Seen in the axial direction of the casing, the combination of spiral and casing is divided into an infeed zone 20, a transport zone 21, a precompaction zone 22 and a compaction zone 23. The cross-sections through each respective zone in the illustrated embodiment are apparent from Figs. 1*a–c*. It will be appreciated from these Figures that the cross-section of the casing in the precompaction zone is substantially circular and surrounds the spiral with slight play. FIG. 1 also shows in by solid lines a relatively abrupt transition between the tranport zone 21 and the precompaction zone 22. However, in certain physical applications, the embodiment shown by broken lines is selected, with a relatively continuous transition between the cross-sections of the transport zone and the precompaction zone.

FIG. 2 shows in particular how the material flow 40 encompasses a relatively small portion of the cross-section of the casing as long as the material is in the transport zone 21, and how the material, on its passage through the precompaction zone, takes up a steadily increasing part of the cross-section in order, in the compaction zone proper, substantially to fill out the entire cross-section FIGS. 3 and 4*a* 4*b* and 4*c* show how the combination of spiral and casing is provided with a counterpressure member 25, 8, for arresting or braking the movement of the material in the compaction zone 23 of the casing. In the embodiment illustrated in FIG. 3, the counter-pressure mentor 25 is formed in that the movement of the material is braked during movement in the longitudinal direction of the casing, because of friction against the inner surface of the casing. In certain physical applications, the braking effect is amplified in that the casing is, in the region of the compaction zone 23, provided with reduced inner cross-section.

Figure 4A:
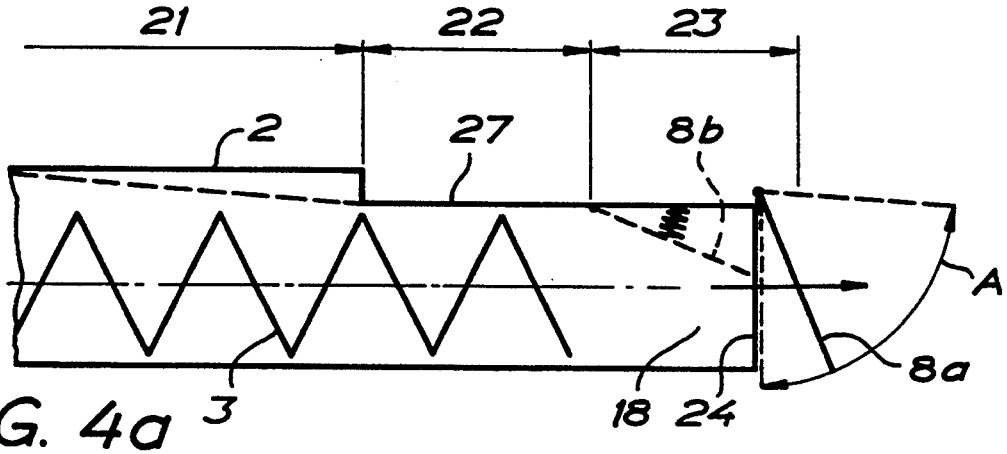
Figure 4B:
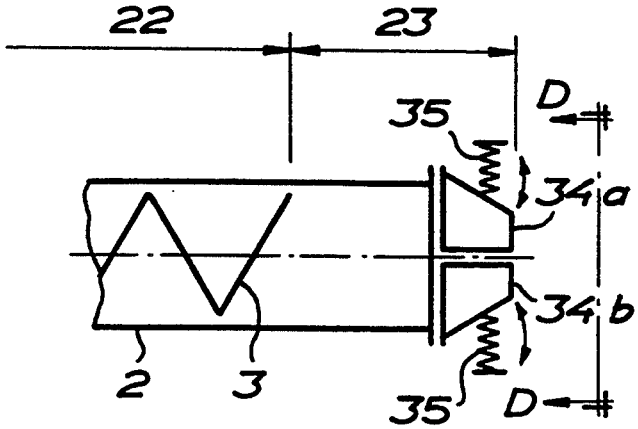
Figure 4C:
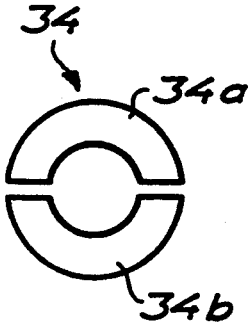

FIG. 4*a* shows, first, one embodiment in which the counterpressure member consists of a counterpressure plate 8*a* disposed in association with the discharge opening 24 and pivotally journalled in conjunction with the upper region of the discharge opening, and movable in the direction of the double-headed arrow A; and secondly, an embodiment in which the counterpressure member consists of a counterpressure plate 8*b* which is pivotal and preferably return spring-biased in the upper defining surface 27 of the casing 2. FIG. 4*b* shows a partial longitudinal section and FIG. 4*c* a view taken along the line D—D in FIG. 4*b* of one embodiment in which the counterpressure member consists of a split cone 34. For example, the cone comprises two halves 34*a* and 34*b* and is openable under the counteraction of springs 35 whose spring force is adapted to provide that counterpressure which is requisite to attain the intended compaction of the material.

Figure 5:
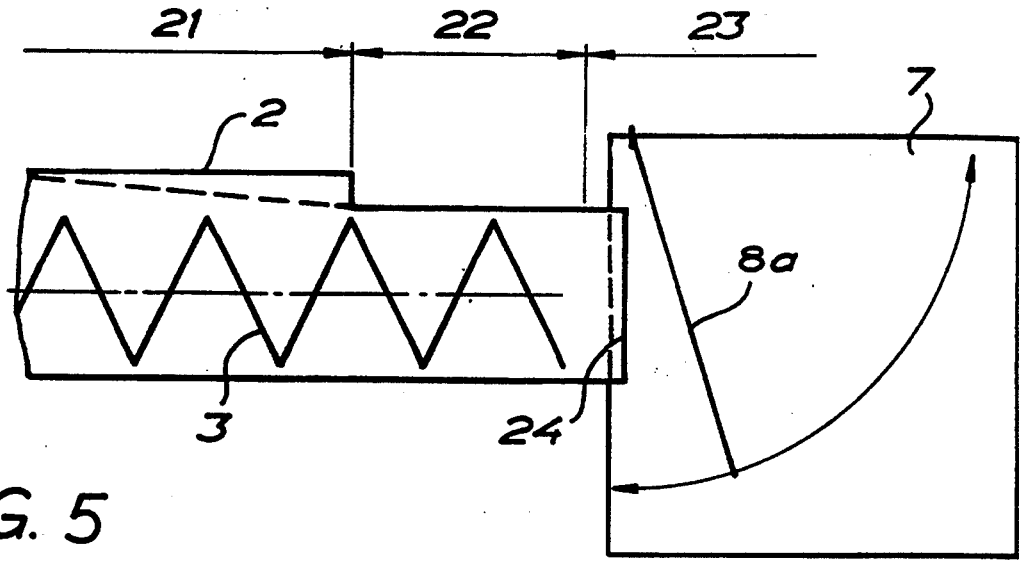

FIG. 5 shows one embodiment in which the counterpressure plate 8*a*, in conjunction with the discharge opening 24, is disposed in a receptacle chamber 7. In the embodiment illustrated in this Figure, the counterpressure plate is journalled in the upper defining surface of the chamber, but the journalling may, for example, correspond to that of those embodiments as shown in FIG. 4.

Figure 6A:
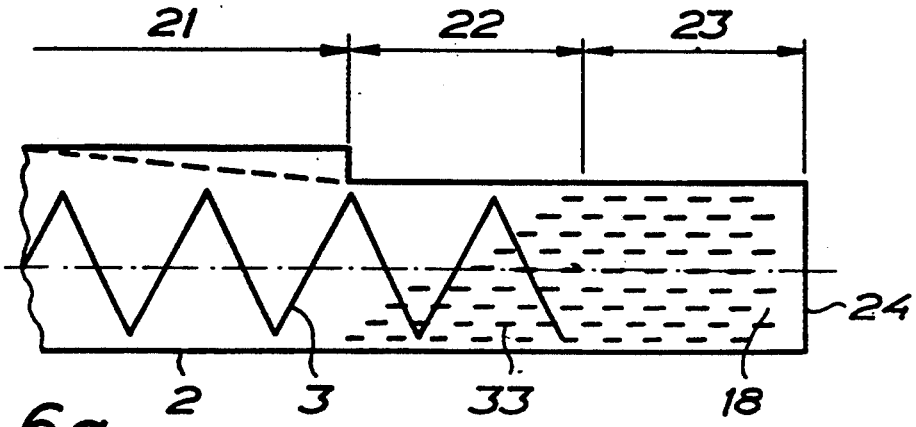
FIGS. 6*a* and *b* are partial sections through embodiments of the apparatus according to the present invention, in which the casing of the apparatus is provided with drainage openings.

FIGS. 6*a* and *b* show embodiments in which the casing 2, in conjunction with the precompaction zone 22 and the compaction zone 23, is provided with drainage openings 33.

Figure 7A:
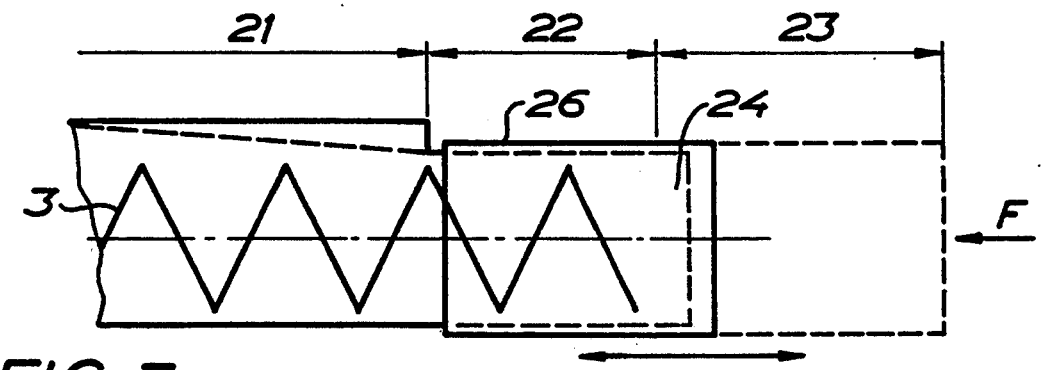
FIGS. 7*a* and *b* are partial sections through embodiments of the apparatus according to the present invention, in which this is provided, in conjunction with its discharge opening with a shiftable receptacle member.
Figure 7B:
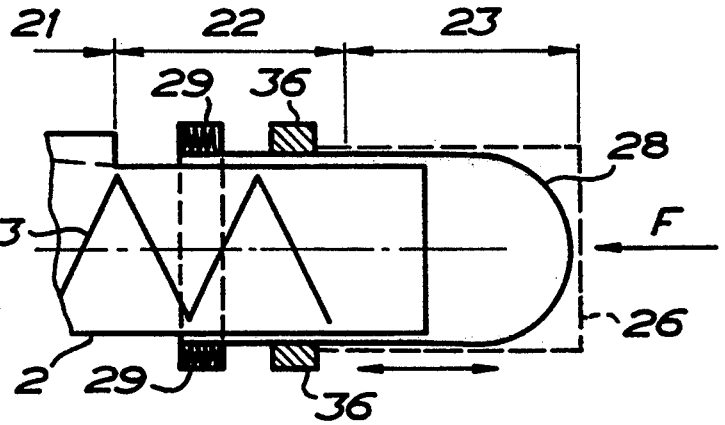

FIGS. 7*a* and *b* show embodiments of the present invention in which the counterpressure member consists of a receptacle device 26, 28, shiftable in the axial direction of the casing and, in FIG. 7*a*, comprising a container 26, while in FIG. 7*b*, a hose 28. in this instance, the hose 28 is drawn out from a magazine 29. In certain embodiments, braking means 36 are provided for restricting the withdrawal of the hose from the magazine. In the Figures, an arrow F designates a force which is counter-directed to the movement of the container. The arrow represents a device, for example a hydraulic cylinder. In FIG. 7*a*, it is shown that, in certain embodiments, the hose 28 cooperates with the container 26 (broken lines) and is brought into abutment with the inner surfaces of the container according as the hose is filled with material from the casing. Thus, FIGS. 7*a* and *b* show embodiments of the invention in which the material surrounded by the container and/or the hose is compacted.

Figure 8A:
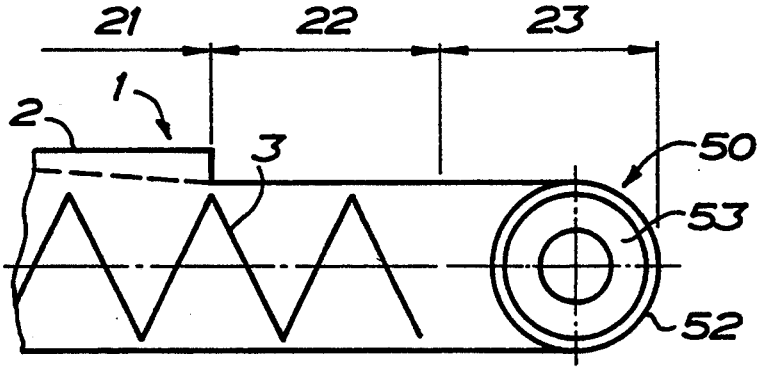
FIGS. 8*a* and *b* are partial sections through one embodiment of the apparatus according to the present invention, in which this, in conjunction with its discharge opening, cooperates with a conveyor apparatus which includes a casing surrounding a shaftless spiral.
Figure 8B:
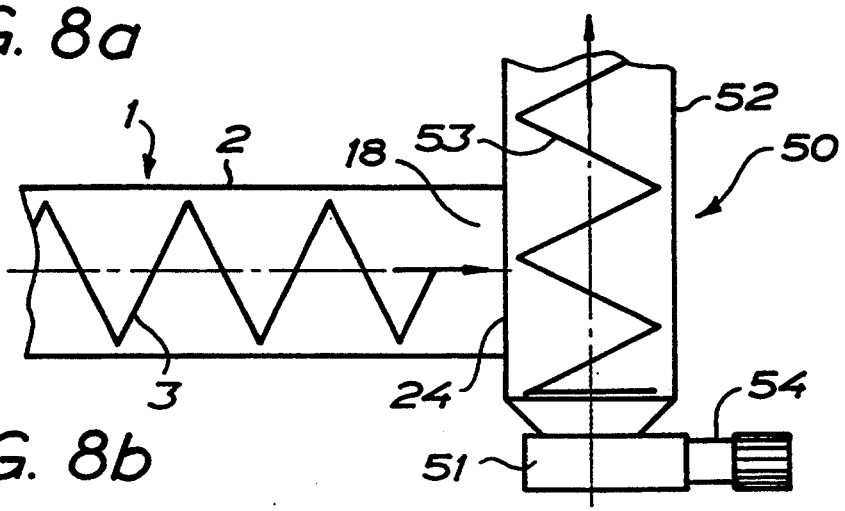

FIGS. 8*a* and *b* show one embodiment of the invention in which the apparatus 1 includes at least one supplementary conveyor apparatus 50 comprising a casing 52 and a shaftless spiral 53 placed therein. The spiral is driven by a motor 54 by the intermediary of a gearing and journalling unit 51 and its speed is, thus, for example by modification of the gear ratio, adjustable to any desired level. The direction of the first spiral 3 and/or a central shaft of the discharge end 18 of the casing is towards the central axis of the spiral 53 of the conveyor apparatus. The opening surface area of the discharge opening 24 of the casing 2 substantially agrees with the cross-sectional area of the receiving casing 52, both of the casings being substantially sealingly interconnected. The conveyor apparatus 50, is, in certain embodiments, disposed to move the material essentially horizontally, while in other embodiments, movement is effected during alteration of the level of the material. There are also embodiments of the present invention in which the casing 52 of the conveyor apparatus 50 with the spiral placed therein, has a substantially vertical direction. In this instance, the free end of the spiral is directed upwardly.

Figure 9A:
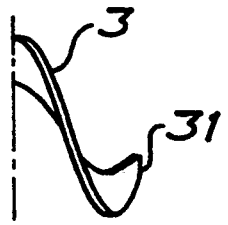
FIGS. 9*a–c* show details of the free end of the spiral.
Figure 9B:
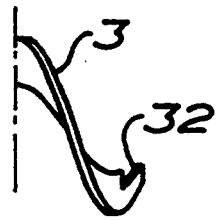
Figure 9C:
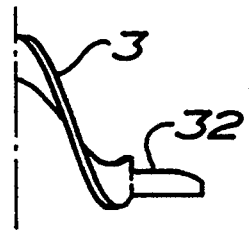

FIGS. 9*a–c* show embodiments of the free end 31–32 of the spiral 3. In FIG. 9*a*, the end 31 of the spiral terminates in such a manner that its blade height continuously diminishes from the inner end outwardly, i.e. the center hole of the spiral increases progressively. FIGS. 9*b* and *c* show embodiments in which the end 32 of the spiral is disposed for a step reduction of its blade height.

Material which is supplied to the apparatus 1 through the infeed opening 14 in the casing 2 is moved in a direction towards the discharge opening 24 by rotation of spiral 3. As will be apparent from FIG. 2, a gathering of material takes place in the precompaction zone 22 partly in that the spiral 3, in certain embodiments, has a smaller pitch than in the transport zone 21, and partly in that the movement of the material is braked in the compaction zone 23 and/or by the counterpressure men,pets 8, 25, 26, 28, and 50. As a result, the material, in the compaction zone, as a rule substantially fills out the entire cross-section of the casing.

In FIGS. 3, 4*a* 4*b*, 4*c* and 5 braking is effected of the movement of the material in the compaction zone 23 by friction against the inner wall of the casing in the compaction zone (FIG. 3), by the action of the counterpressure plates 8*a*, 8*b* (FIGS. 4 and 5), or by a combination of friction and pressure which is obtained in that the cross-section (FIG. 3) of the casing diminishes, or alternatively in that the casing terminates in the cone 34 (FIG. 4*b*).

Figure 6B:
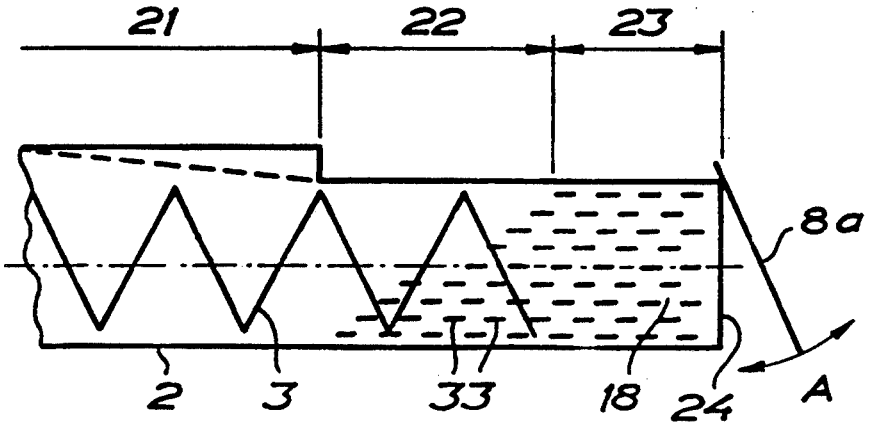

In the embodiments illustrated in FIGS. 6*a* and 6*b*, a reduction is effected of the liquid-content of the material, during passage through the precompaction zone 22 and the compaction zone 23. In many examples of physical application, the casing 2 is, in such instances, disposed such that the material is moved slightly upwardly when it passes in a direction towards the discharge opening 24. Hereby, drainage of the material will be facilitated, since a portion of the liquid will pass in a direction opposite to the direction of movement of the material and substantially in the center of the shaftless spiral, before the liquid runs out through the drainage openings 33. As a result, it will be possible for the liquid to reach the drainage openings of the casing in a region where the material has not yet had time to be compacted to any appreciable degree. Hence, as seen in FIGS. 6*a* and 6*b* the drainage openings extend over an axial extent of the casing which increases gradually from the top of the casing to the bottom of the casing. The drainage openings at the bottom of the casing extend from the beginning of the precompaction zone 22 whereas the drainage openings at the top of the casing extend from the beginning of the compaction zone 23.

On movement of material into the container 26 or into the hose 28 (Cf. FIGS. 7*a* and *b*), the container, the hose—or alternatively the hose in combination with the container—is progressively forced out from the casing 2 by the action of forces from the material, at the same time as the material is compacted and then attains, as a rule, a degree of compaction which is in addition to the previously-attained compaction.

In the embodiment illustrated in FIGS. 8*a* and *b*, the conveyor apparatus 50 constitutes a counterpressure member in that the dimensions, pitch and speed of the spiral 53 have been selected such that the material is braked in its movement on passage out from the discharge opening 24 of the casing 2. There will hereby be obtained the desired compaction of the material when this is located in the casing 52 of the receiving combination, and thereby requisite filling of the casing of the receiving combination.

The above-described counterpressure members are, in certain embodiments, combined so that, for example, there will be included in one and the same apparatus, a ccounter-pressure plate 8*a*, *b*, and a terminating conical portion of the casing; a counterpressure plate 8*a*, *b*, and a shiftable receptacle member 26, 28; a cone 34 and the receiving casing 52 with spiral 53; and so on.

In certain physical applications of the invention, a braking of the material takes place in the precompaction zone to such a great extent that at least that section of the casing located most proximal the compaction zone will be as good as completely filled with material. The thus compacted material is thereafter caused to leave casing through its discharge opening 24 in batches whose size is determined by the rotation of the spiral (the angular alteration which the spiral undergoes), in conjunction with each discharge occasion. Hence, the present invention offers a simple and reliable technique for the batchwise discharge, with a relatively high degree of accuracy, of material from an apparatus according to the present invention.

The above detailed description refers only to a limited number of embodiments of the present invention, but the skilled reader of this Specification will readily perceive that many modifications and embodiments of the present invention are conceivable without departing from the spirit and scope of the appended Claims.

What is claimed is:

1. An apparatus for conveying and compacting material comprising an elongated casing having an open end, a shaftless spiral disposed in said casing, said shaftless spiral comprising a continuous blade wound spirally at a determined pitch and forming a free central annular passage longitudinally along the length of the spiral, supply means in said casing for feeding the material thereinto, drive means for rotating said shaftless spiral in said casing to cause said spiral to advance said material through said casing, said casing having an outlet at said open end towards which the material is advanced by said spiral, said spiral having a terminal free end, beyond which said casing includes an end section, and counterpressure means formed at least in part by said end section for opposing advance of said material in said end section to form a compaction zone in said end section in which said material is compacted, said central passage in said shaftless spiral providing communication at said terminal free end of said spiral between the material in said end section and the material in the shaftless spiral and providing a precompaction zone for the material in an end region of the shaftless spiral, said shaftless spiral having a substantially uniform outer diameter in said precompaction zone, said casing having a substantially uniform diameter in said precompaction and said compaction zones, and means including drainage openings distributed in said casing inclusive of said end region of said spiral for removal of liquid from the material in said precompaction zone during passage of the material in said casing.

2. The apparatus as claimed in claim 1 wherein said drainage openings extend in said casing in said compaction zone.

3. The apparatus as claimed in claim 1 wherein the said drainage openings in the compaction zone and the precompaction zone extend over an axial extent of the casing which increases from a top of the casing to a bottom of the casing.

4. The apparatus as claimed in claim 1 wherein said counterpressure means is disposed at the outlet of said casing.

5. The apparatus as claimed in claim 1 wherein said counterpressure means comprises a spring-loaded counterpressure plate movably journaled to said casing.

6. The apparatus as claimed in claim 5 wherein said counterpressure plate is pivotally connected to said casing in said end section.

7. The apparatus as claimed in claim 5 wherein said counterpressure plate is pivotally connected at said outlet of the casing.

8. The apparatus as claimed in claim 7 comprising a receptacle chamber at said outlet of the casing, said counterpressure plate being pivotally connected to said receptacle chamber.

9. The apparatus as claimed in claim 1 wherein said counterpressure means comprising a split cone including opposed spring-loaded members at said outlet of the casing.

10. The apparatus as claimed in claimed 9 comprising a receptacle chamber at said outlet of the casing, said split cone being in said receptacle chamber.

11. The apparatus as claimed in claim 1 wherein said end section has a wall with an interior surface which applies counterpressure to the material in said end section.

12. The apparatus as claimed in claim 1 wherein said counterpressure means comprises a flexible hose on said end section expandable axially of said casing under the pressure of the material discharged from said casing.

13. The apparatus as claimed in claim 12 comprising a magazine on said container, said hose being mounted in said magazine for being drawn out therefrom by the material being discharged from the casing.

14. The apparatus as claimed in claim 1 wherein said counterpressure means comprises a second casing having an inlet means sealably connected to said outlet of the first said casing, and a further shaftless spiral in said second casing, said second casing having a cross-sectional area at said inlet means which corresponds substantially to the cross-sectional area of said first casing.

15. The apparatus as claimed in claim 14 comprising drive means for said further shaftless spiral.

16. The apparatus as claimed in claim 15 wherein said second casing is upright and has an outlet above the inlet means thereof.

17. The apparatus as claimed in claim 1 wherein said drive means is connected to said shaftless spiral at an end thereof remote from said free end.

18. The apparatus as claimed in claim 17 wherein said spiral extends in said casing freely without support from said drive means.

19. The apparatus as claimed in claim 1 wherein said counterpressure means is displaceable relative to said casing.

20. The apparatus as claimed in claim 1 wherein said casing has a circular cross section in said precompaction zone and said spiral has a diameter forming an outer surface closely confronting said casing to form slight play with said casing.

* * * * *